US007669725B2

(12) United States Patent
Randolph et al.

(10) Patent No.: US 7,669,725 B2
(45) Date of Patent: Mar. 2, 2010

(54) BOTTLE ASSEMBLY

(75) Inventors: Ross Steven Randolph, Rockaway, NJ (US); Paul Bertram, Franklin, MA (US)

(73) Assignee: Playtex Products, Inc., Westport, CT (US)

( * ) Notice: Subject to any disclaimer, the term of this patent is extended or adjusted under 35 U.S.C. 154(b) by 1299 days.

(21) Appl. No.: 10/793,340

(22) Filed: Mar. 4, 2004

(65) Prior Publication Data

US 2005/0056610 A1 Mar. 17, 2005

Related U.S. Application Data

(63) Continuation-in-part of application No. 10/663,445, filed on Sep. 16, 2003, now Pat. No. 7,326,234.

(51) Int. Cl.
*A61J 9/00* (2006.01)
*A61J 11/00* (2006.01)

(52) U.S. Cl. ..... 215/12.1; 215/11.1; 215/11.3; 215/11.6; 220/23.91

(58) Field of Classification Search ..... 215/11.1, 215/11.6, 12, 1, 11.3, 12.1, 13.1, 10; 220/62.18, 220/592.15–592.17, 392.17, 592.27, 23.91
See application file for complete search history.

(56) References Cited

U.S. PATENT DOCUMENTS 1,221,335 A * 4/1917 Kline ..... 215/13.1
1,589,138 A * 6/1926 Fisk ..... 215/11.6
1,706,034 A * 3/1929 Moore ..... 215/11.6
2,077,218 A * 4/1937 Conner ..... 215/12.1
2,311,397 A * 2/1943 Kazimirow ..... 215/11.6
2,493,380 A * 1/1950 Bailey ..... 215/11.5
2,623,229 A * 12/1952 Brinton ..... 401/128
2,817,452 A * 12/1957 Bramming ..... 215/12.1
2,826,324 A * 3/1958 Hoag ..... 215/11.3
2,828,043 A * 3/1958 Hosford, Jr. ..... 220/592.22
2,859,891 A * 11/1958 Carkin ..... 215/11.3
2,865,524 A * 12/1958 Reznek ..... 215/6
2,876,113 A * 3/1959 Barton ..... 426/117
2,981,430 A * 4/1961 Chin et al. ..... 215/12.1
3,039,639 A * 6/1962 Hassid ..... 215/12.1
3,161,311 A * 12/1964 Boston ..... 215/11.3
3,229,840 A * 1/1966 Filleul ..... 215/2
3,241,209 A * 3/1966 Taylor ..... 215/13.1
3,362,555 A * 1/1968 Soto ..... 215/11.3
3,481,500 A * 12/1969 Palma ..... 215/11.5
3,851,781 A * 12/1974 Marco ..... 215/11.3
3,871,543 A * 3/1975 Chadfield et al. ..... 215/12.1
4,236,647 A * 12/1980 Kotturan ..... 215/247
4,339,046 A * 7/1982 Coen ..... 215/11.5
4,771,911 A * 9/1988 Morony et al. ..... 220/592.16

(Continued)

FOREIGN PATENT DOCUMENTS

GB 2214891 A * 9/1989

*Primary Examiner*—Sue A Weaver
(74) *Attorney, Agent, or Firm*—Ohlandt, Greeley, Ruggiero & Perle, L.L.P.

(57) ABSTRACT

A bottle assembly is provided. The bottle has inner and outer bodies that are selectively engageable and form a space therebetween for insulation by air. The inner and outer bottles can be selectively secured by a deformable collar. The bottle assembly may have a vented nipple that promotes latch-on to an areola region of the nipple.

17 Claims, 11 Drawing Sheets

U.S. PATENT DOCUMENTS 4,982,769 A * 1/1991 Fournier et al. ..... 141/98
5,069,351 A * 12/1991 Gunderson et al. ..... 215/11.1
5,094,363 A * 3/1992 Monahan et al. ..... 222/131
5,419,445 A * 5/1995 Kaesemeyer ..... 215/11.1
5,897,007 A * 4/1999 Schein et al. ..... 215/11.1
5,901,882 A * 5/1999 Siegel ..... 222/131
6,164,469 A * 12/2000 Sartore ..... 215/12.1
6,308,846 B1 * 10/2001 Muller ..... 215/13.1
6,516,967 B2 * 2/2003 Duff et al. ..... 220/592.16
6,601,720 B2 * 8/2003 Meyers et al. ..... 215/11.5
6,612,428 B1 * 9/2003 Segovia et al. ..... 206/219
6,629,618 B1 * 10/2003 Volan ..... 215/12.1
6,631,819 B1 * 10/2003 Diak/Ghanem ..... 215/11.1
2002/0000419 A1 * 1/2002 Mueller ..... 215/13.1
2003/0085193 A1 * 5/2003 Hsu ..... 215/11.1

* cited by examiner

BOTTLE ASSEMBLY

RELATED APPLICATION

This application is a continuation-in-part of application Ser. No. 10/663,445, filed Sep. 16, 2003, U.S. Pat. No. 7,326, 234, the disclosure of which is incorporated in its entirety herein by reference.

BACKGROUND OF THE INVENTION

1. Field of the Invention

The present invention relates to bottles. More particularly, the present invention relates to insulated bottles.

2. Description of Related Art

Bottles having a feeding apparatus, such as a baby bottle having a flexible nipple, are commonly used to feed infants, children or adults with milk, formula, juices and other fluids. These bottles provide for engagement of the feeding apparatus, e.g., the nipple, with the body of the bottle. A typical bottle has an open upper end that is threaded for engagement of a nipple ring, which attaches the nipple to the open end.

While providing safety against breakage, and facilitating feeding through the use of a nipple, these contemporary bottles suffer from the drawback of failing to adequately insulate the contents contained therein.

Accordingly, there is a need for a bottle and/or a baby bottle that reduces or eliminates these drawbacks. There is a further need for a bottle that provides proper insulation while providing safety against breakage and facilitating feeding, cleaning and manufacturing.

SUMMARY OF THE INVENTION

It is an object of the present invention to provide a bottle that is thermally insulated.

It is another object of the present invention to provide such a bottle with components that are selectively connectable.

It is yet another object of the present invention to provide such a bottle that facilitates feeding, cleaning and manufacture.

It is yet a further object of the present invention to provide such a bottle that facilitates use, assembly and storage.

It is still a further object of the present invention to provide such a bottle that facilitates manipulation and handling.

These and other objects and advantages of the present invention are provided by a bottle assembly having selectively removable components that can be assembled to provide an insulation layer between a pair of bottles.

In another aspect, a bottle is provided that has an outer body and an inner body. The inner body has an inner volume for storage therein and is selectively connectable with the outer body. The inner body is at least substantially disposed in the outer body when connected thereto. A gap or separation is formed between the inner and outer bodies when they are connected thereby providing a layer of thermal insulation for the contents of the inner body.

In another aspect, a method of thermally insulating the contents of a bottle assembly is provided. The method includes, but is not limited to, removably connecting a first bottle with a second bottle thereby substantially disposing the second bottle in the first bottle, and capturing air during connection between the first and second bottles to form an insulation layer for the contents of the second bottle.

In another aspect, a nipple for a bottle is provided that has a stem, a base and a vent. The stem has an orifice, a proximal end and a distal end. The base is connected to the proximal end of the stem. The base has an areola region and a bulbous region. The areola region is disposed between the proximal end of the stem and the bulbous region. The areola region has a first curved outer surface and the bulbous region has a second curved outer surface. The vent provides fluid communication between atmosphere and the bottle.

In another aspect, a nipple for a bottle is provided that has a stem having a stem surface with a stem texture; a base having a base surface with a base texture; and a vent providing fluid communication between atmosphere and the bottle. At least a portion of the base texture is different from at least a portion of the stem texture.

The outer body or bottle can have a curved shape. The inner body or bottle can have a substantially cylindrical shape. The inner body may have an upper end and a lower end, and the inner body can be inwardly tapered toward the lower end. The bottle can also have a nipple that is selectively connectable to the inner bottle.

Either or both of the outer body and the inner body can have anti-rotation structures that prevent the outer and inner bodies from rotating with respect to each other when connected. The anti-rotation structures may be a first detent structure formed on an outer surface of the inner body and a second detent structure formed on an inner surface of the outer body, where the first and second detent structures are engageable. The first detent structure can be a first set of teeth and the second detent structure can be a second set of teeth. The first and second set of teeth can mesh.

The first set of teeth can extend along substantially all of an outer circumference of the inner body and the second set of teeth can extend along substantially all of an inner circumference of the outer body. The bottle can also have a flexible member that selectively engages the outer body with the inner body. The flexible member may have a non-circular shape. The flexible member can have an oval shape. The flexible member can be a ring having an inner surface with first and second securing members. The first securing member can connect or engage the flexible member to the outer body and the second securing member can connect or engage the flexible member to the inner body.

The outer body can have a first flange extending outwardly therefrom. The inner body can have a second flange extending outwardly therefrom. The first securing member may removably connect to the first flange and the second securing member may removably connect to the second flange. The second securing member can be a pair of securing members diametrically opposed along the inner surface of the flexible member. The pair of securing members each can have a distal edge that is chamfered and the second flange can have a lower edge that is chamfered.

The flexible member may have an outer surface opposite the inner surface and that outer surface can have a pair of indicators disposed thereon. The indicators can represent a portion of the flexible member that is to be squeezed thereby releasing the inner body from the flexible member.

The method of insulating the bottle assembly may also include preventing rotation of the first and second bottles with respect to each other after being connected. The removable connection of the first and second bottles can be done by deforming a flexible member to release the first bottle from the second bottle. The method may also include indicating at least one portion of the flexible member that is to be deformed to release the first bottle from the second bottle.

The first curved outer surface of the nipple can be outwardly convex. The base may have only two portions, which are the areola region and the bulbous region. The stem can be inwardly tapered toward the distal end. The stem may be substantially concentrically aligned with the areola region and the bulbous region when viewed in a top view. The second curved outer surface can be outwardly convex.

The nipple may have a flange extending outwardly from the bulbous region, where the vent is disposed along a bottom surface of the flange. The base texture can be a first texture and a second texture. The first texture can be disposed between the stem texture and the second texture. The first texture can be different from the stem texture. The first texture may be rough. The stem texture may be smooth. The second texture can be smooth. The first texture may be disposed along the base surface on an outwardly curved region.

Other and further objects, advantages and features of the present invention will be understood by reference to the following:

DETAILED DESCRIPTION OF THE INVENTION

Figure 1:
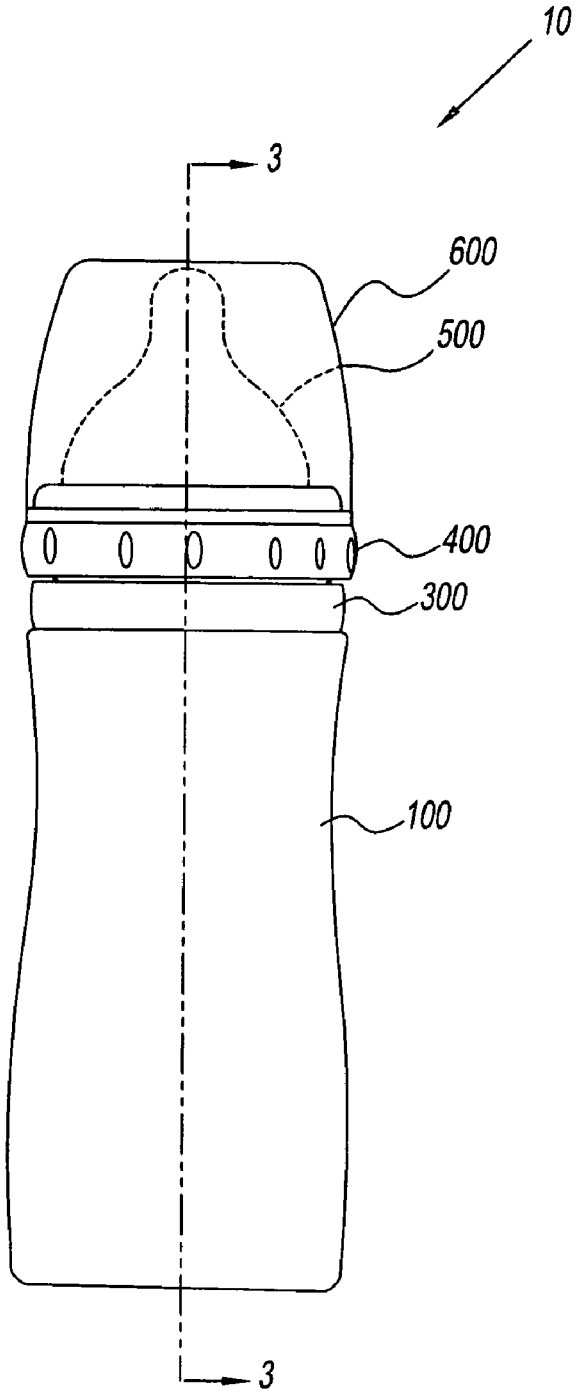
FIG. 1 is a plan view of a preferred embodiment of the bottle assembly of the present invention.
Figure 2:
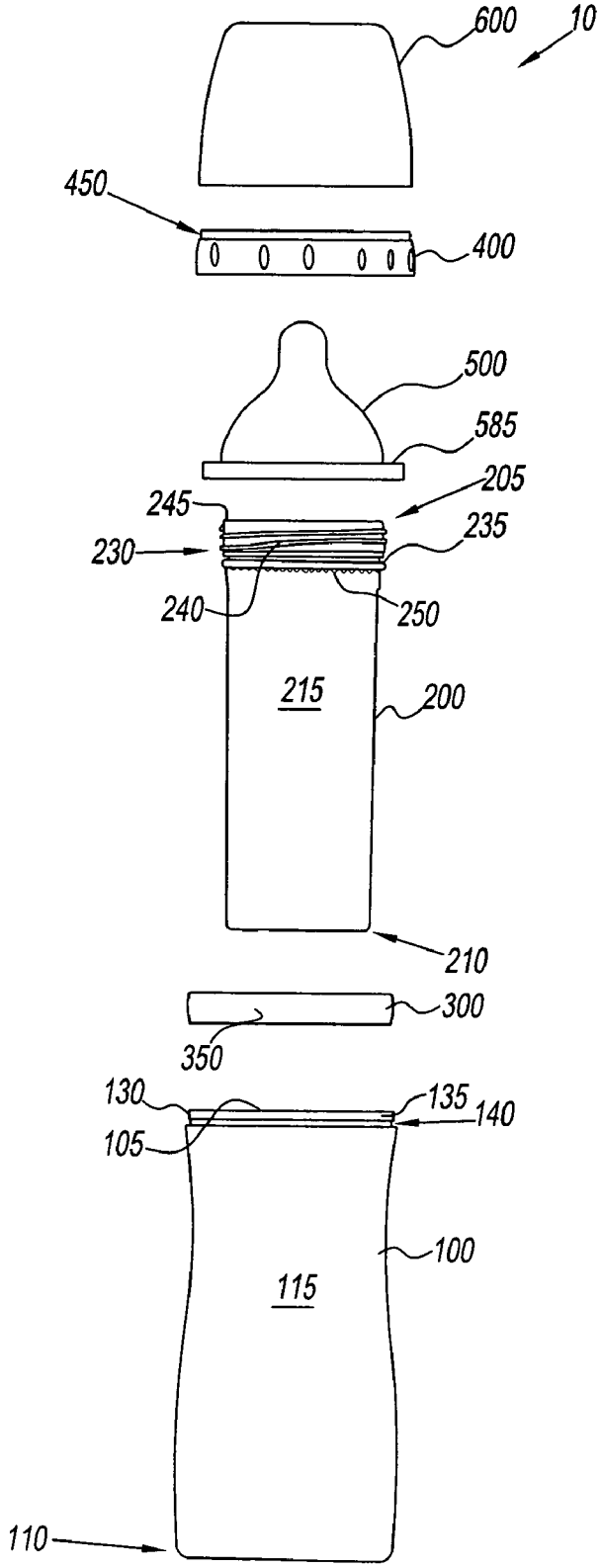
FIG. 2 is an exploded plan view of the bottle assembly of FIG. 1.

Referring to the figures, and in particular FIGS. 1 and 2, a preferred embodiment of the bottle assembly of the present invention is generally referred to by reference numeral 10. The bottle assembly 10 includes a first or outer bottle 100, a second or inner bottle 200, a squeeze collar 300, a nipple ring 400, a feeding apparatus or nipple 500, and a hood 600. As will be described herein, outer and inner bottles 100, 200 are selectively engageable or connectable to provide an insulated bottle assembly 10 with liquid or food being contained in the inner volume of the inner bottle.

Referring to FIGS. 1 through 5, outer bottle 100 has a first end 105 and a second end 110. First end 105 is open and second end 110 is closed. Preferably, outer bottle 100 has a body 115 with a curved shaped that facilitates handling and manipulation of the bottle assembly 10 by providing a narrower area or portion that is easy to grasp. More preferably, body 115 has an hour-glass-like shape, e.g., a middle or upper-middle portion of the outer bottle 100 that has a smaller diameter than the diameters of the first and second ends 105, 110.

The difference in shape of outer bottle 100, as compared to the shape of inner bottle 200, which is preferably a substantially straight cylinder, provides a separation or gap 120 (shown clearly in FIG. 3) between the inner and outer bottles. Separation 120 captures and contains air when the inner bottle 200 is assembled with, and substantially into, the outer bottle 100, thereby providing thermal insulation for the contents of the inner bottle. While the preferred embodiment has an outer bottle 100 with a non-linear cylindrical shape, the present invention contemplates the use of other shapes for either or both of the outer bottle 100 and the inner bottle 200 so that the separation 120 is formed therebetween when assembled. The present invention also contemplates the use of first and second shapes for the outer and inner bottles 100, 200, respectively, where the first and second shapes are different to form the separation 120 therebetween.

Outer bottle 100 has a first neck 130 defining the opening of first end 105. Preferably, first neck 130 is of a reduced diameter as compared to the diameter of body 115. However, the present invention contemplates the use of the same diameter or even a larger diameter for the first neck 130 as compared to the body 115. First neck 130 has a first annular flange 135 formed along the top portion of the first neck. First annular flange 135 is outwardly extending from first neck 130.

Preferably, first annular flange 135 is formed continuously along the outer circumference of the first neck 130. However, first annular flange 135 can alternatively be formed into separate pieces or members along the outer circumference of the first neck 130. The first annular flange 135 and the body 115 form an annular channel 140 therebetween along first neck 130 of outer bottle 100. As will be described later in greater detail, the first annular flange 135 and the annular channel 140 are used with the squeeze collar 300 for selectively engaging, connecting or locking the outer bottle 100 with the inner bottle 200.

Figure 3:
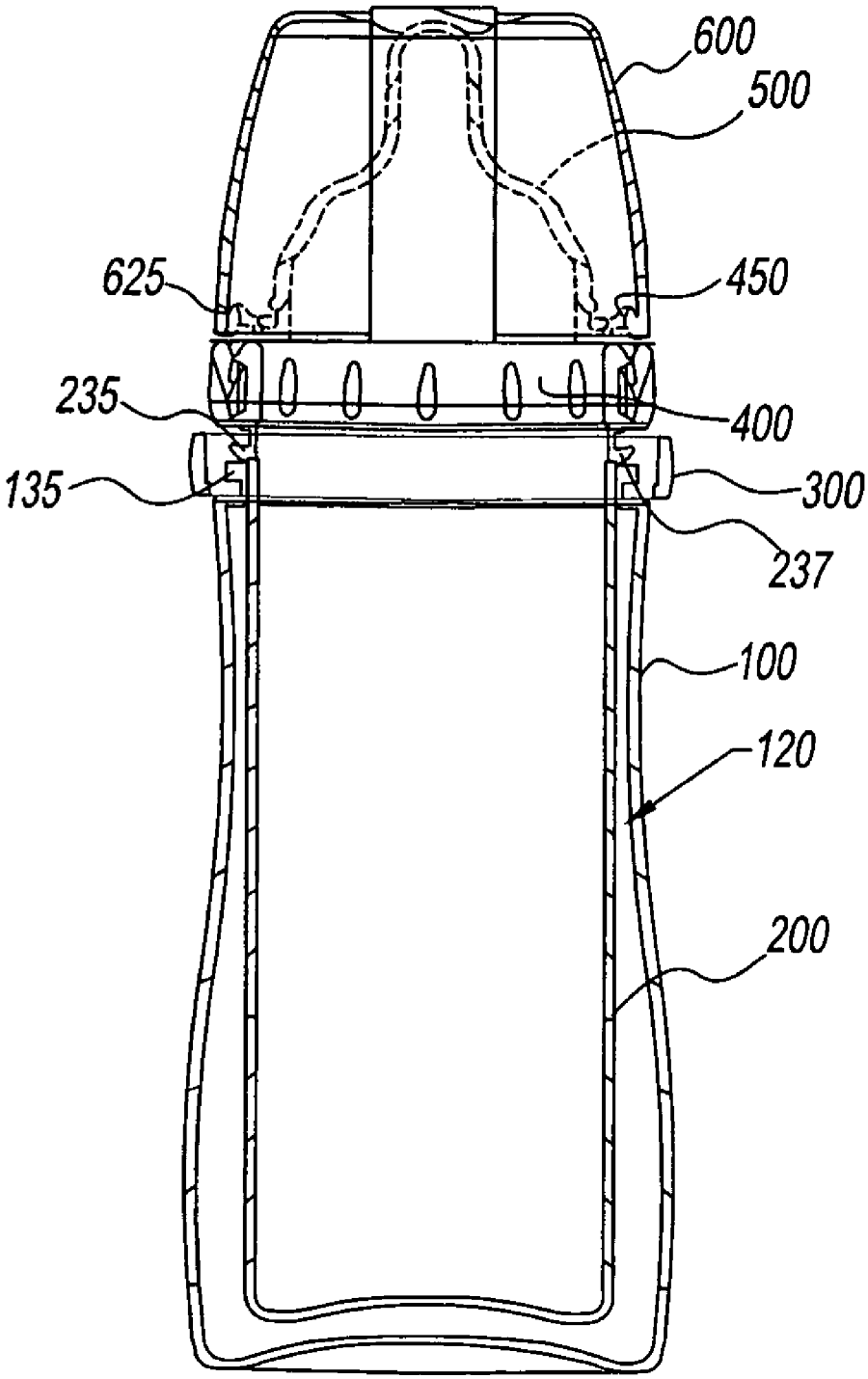
FIG. 3 is a cross-sectional view of the bottle assembly of FIG. 1 taken along line 3-3 of FIG. 1.
Figure 4:
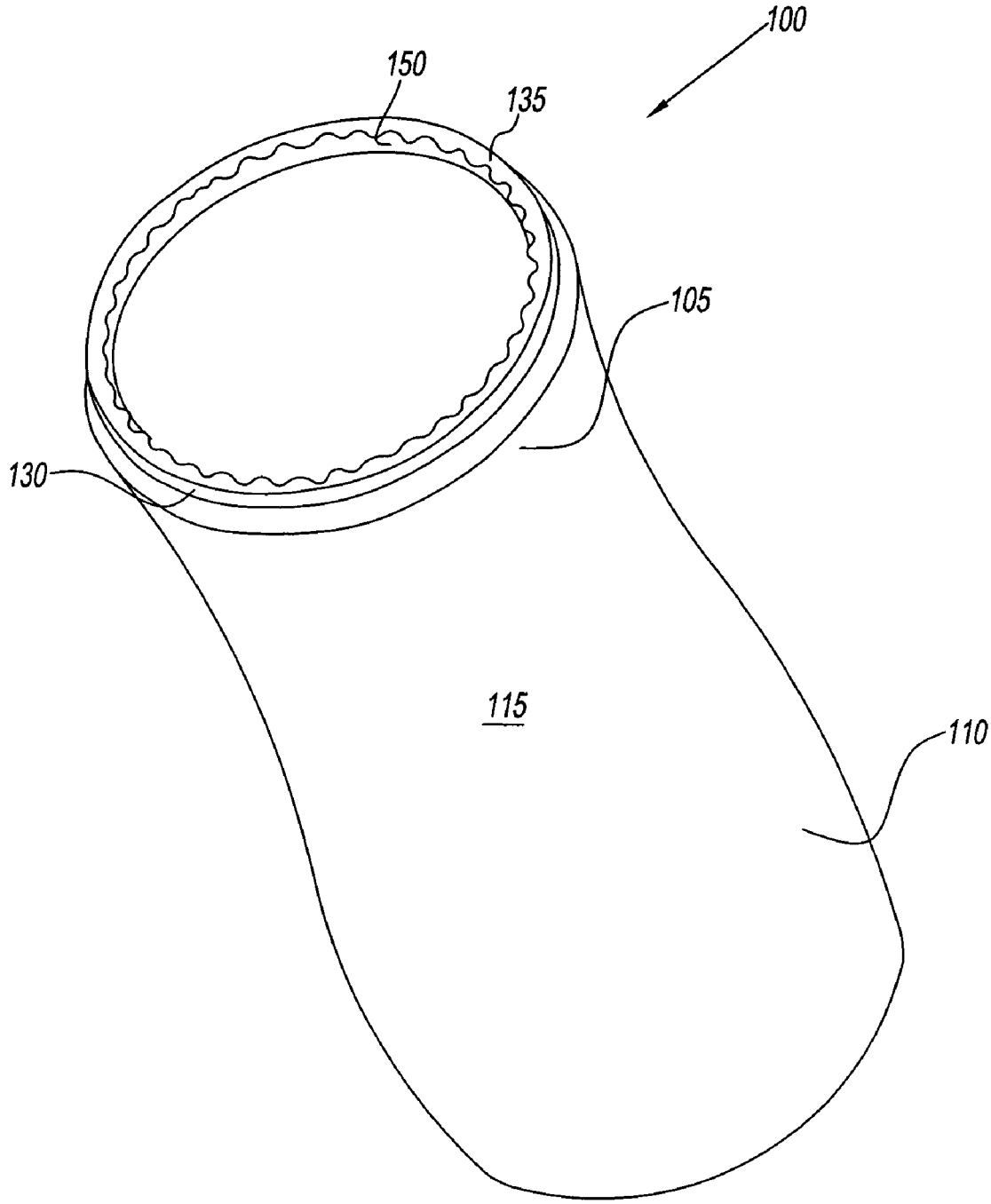
FIG. 4 is a perspective view of the outer bottle of FIG. 1.
Figure 5:
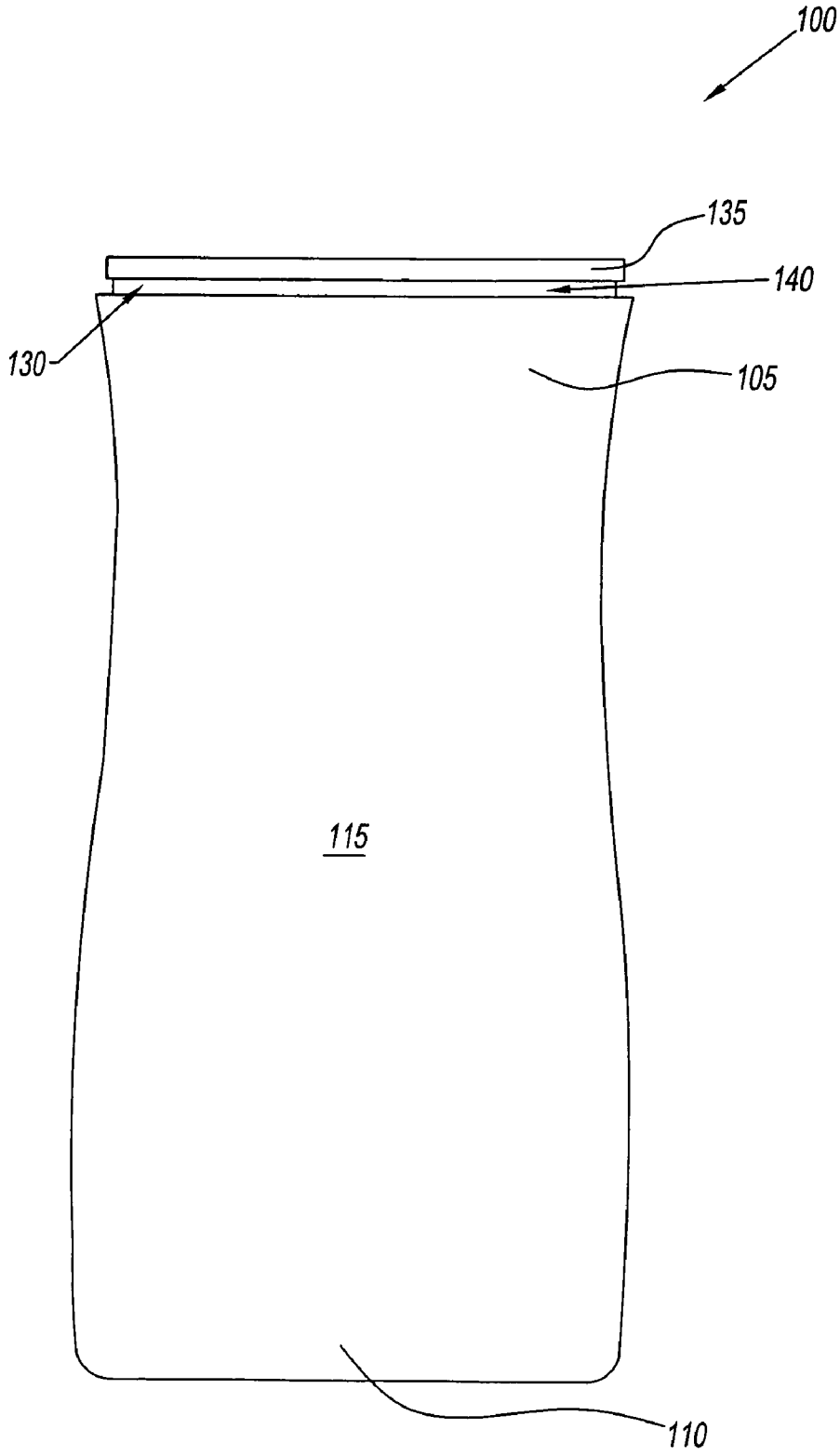
FIG. 5 is a plan view of the outer bottle of FIG. 4.
Figure 6:
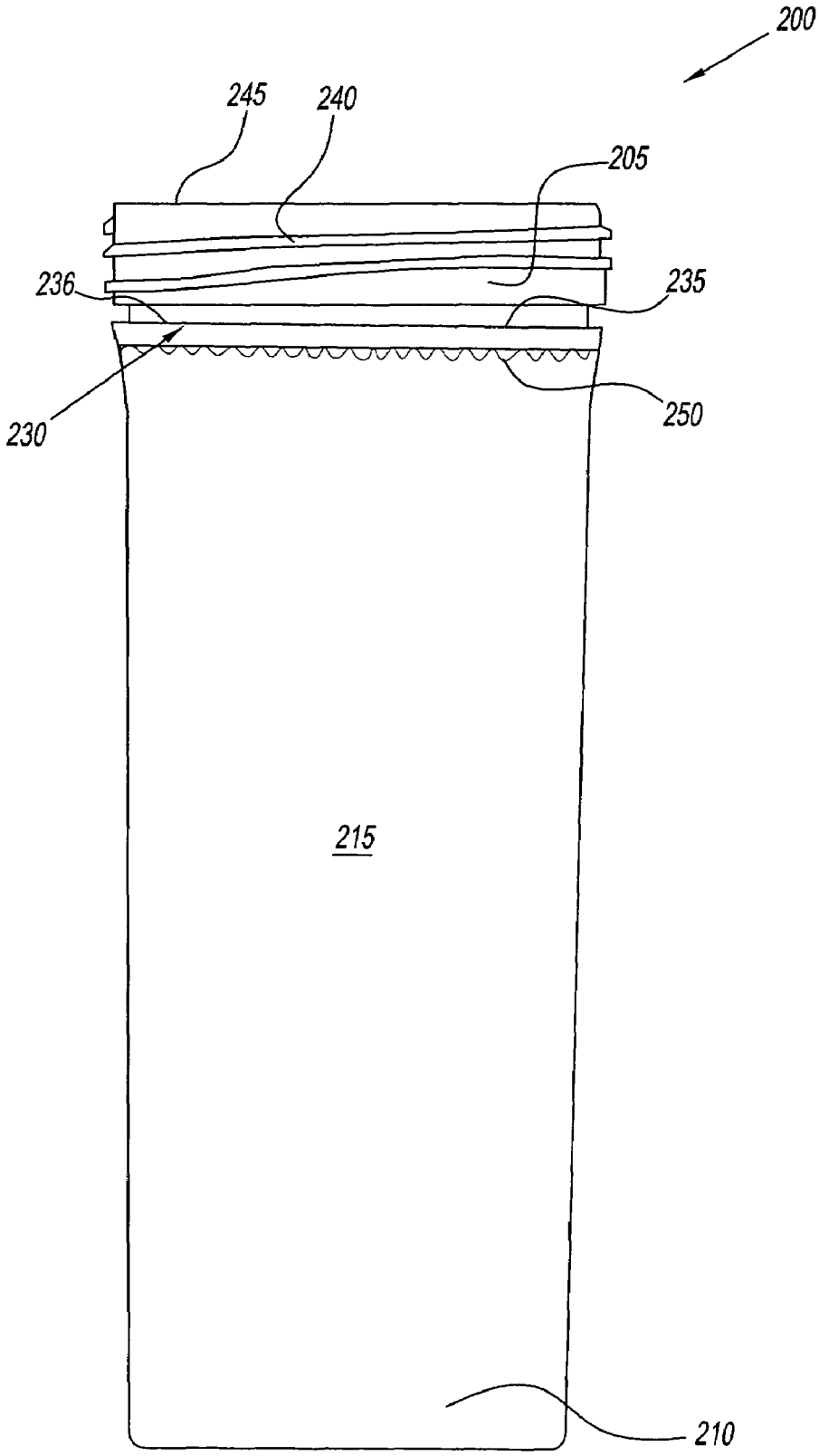
FIG. 6 is a plan view of the inner bottle of FIG. 2.
Figure 7:
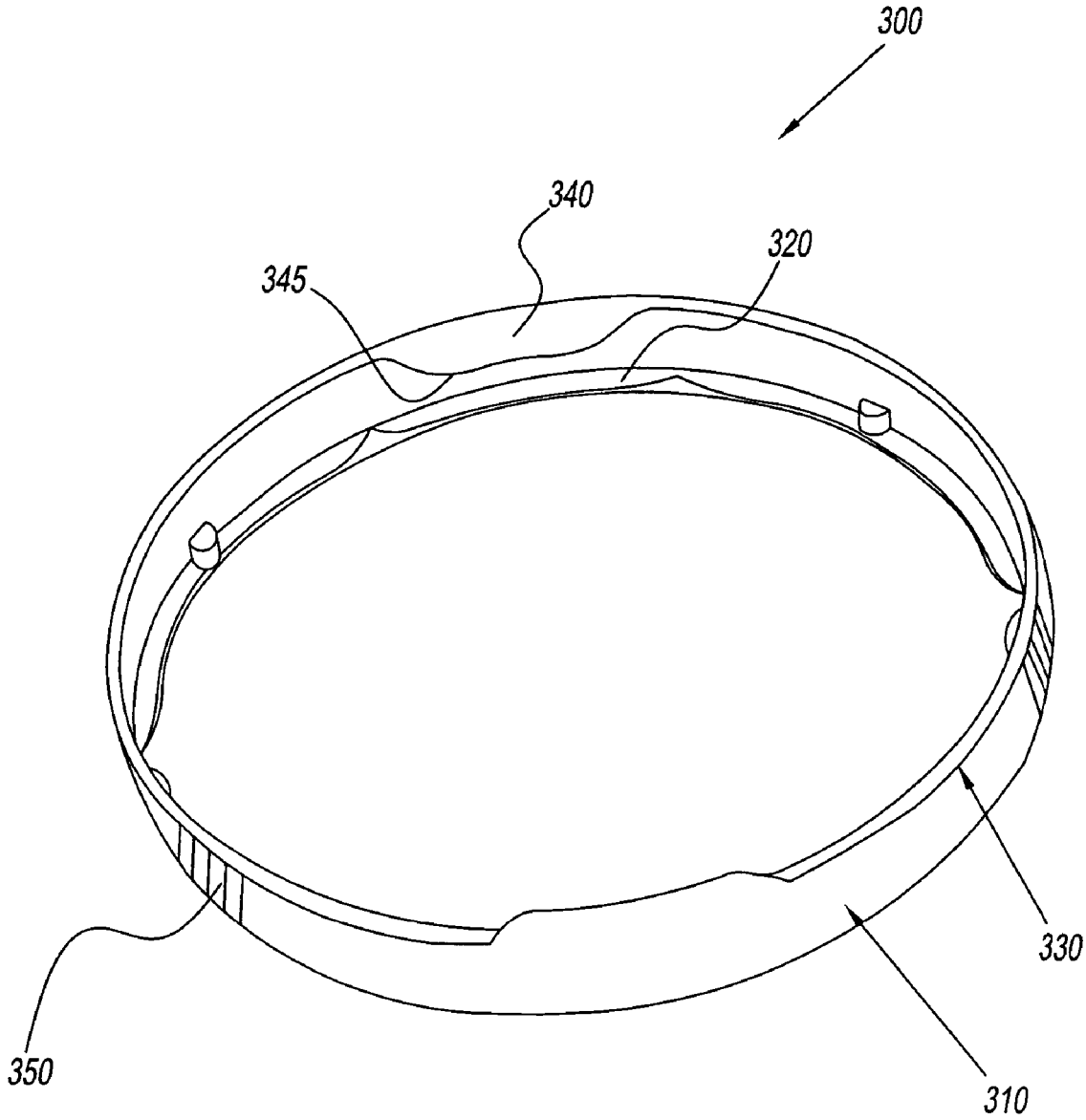
FIG. 7 is a perspective view of the squeeze collar of FIG. 2.

Referring to FIGS. 2, 3 and 6, inner bottle 200 has a third end 205 and a fourth end 210. The third end 205 is open and the fourth end 210 is closed. Preferably, inner bottle 200 has a body 215 with a substantially cylindrical shape that inwardly tapers towards fourth closed end 210. The outer diameter of body 215 is smaller than the inner diameter of first open end 105 and body 115 of outer bottle 100 so that the inner bottle can be slid through the first open end and substantially disposed in the outer bottle. The tapered shape of body 215 facilitates insertion of the inner bottle 200 into the outer bottle 100.

As described above, the difference in shape of outer bottle 100 as compared to the shape of inner bottle 200 provides the separation 120 between the inner and outer bottles for insulating the bottle. However, the present invention contemplates the use of other shapes for either or both of the outer bottle 100 and the inner bottle 200 so that various shapes of separation or gap 120 can be formed therebetween when the outer and inner bottles are assembled. Additionally, separation 120 can be formed with a non-linear shape resulting from the difference in the shape of outer and inner bottles 100, 200.

Inner bottle 200 has a second neck 230 defining the opening of third end 205. Preferably, second neck 230 is of a similar diameter to the diameter of body 215. However, the present invention contemplates the use of a reduced diameter or even a larger diameter for the second neck 230 as compared to the body 215 of inner bottle 200. Second neck 230 has a second annular flange 235 formed along the bottom portion of the second neck. Second annular flange is outwardly extending from the second neck 235.

Preferably, second annular flange 235 is formed continuously along the outer circumference of second neck 230. However, second annular flange 235 can also be formed into separate pieces or members along the outer circumference of the second neck 230. Second annular flange 235 has an upper surface 236 and a lower surface 237. Preferably, lower surface 237 of second annular flange 235 is a chamfered or an angled edge. As will be described later in greater detail, the chamfered lower edge 237 of second annular flange 235 facilitates selective connection of the squeeze collar 300 with the inner bottle 200.

Second neck 230 of inner bottle 200 preferably has outer threads 240 formed thereon. Threads 240 correspond to, and provide for engagement with, inner threads on the nipple ring 400 so that the nipple 500 can be connected with the outer and inner bottles 100, 200. While the preferred embodiment threadingly engages the nipple ring 400 and nipple 500 with the outer and inner bottles 100, 200, the present invention contemplates the use of other connection structures or methods for selectively connecting the nipple ring and nipple with the outer and inner bottles. Such other connections include, but are not limited to, a snap-fit. Second neck 230 has an upper surface or rim 245, preferably flat, upon which the nipple 500 can be seated and substantially sealingly engaged therewith.

Referring to FIGS. 1 through 7, the outer and inner bottles 100, 200 can be selectively removed and engaged with each other, and locked, connected or engaged through the use of squeeze collar 300. Squeeze collar 300 is preferably a separate component, and more preferably a ring. Squeeze collar 300 preferably has an oval shape. However, the present invention contemplates the use of other shapes for squeeze collar 300 to provide for selective connection of the outer bottle 100 with the inner bottle 200. In the preferred embodiment, the squeeze collar 300 is made from a material or materials having enough flexibility to allow a user to deform the oval shape into a circular shape by squeezing opposing ends of the collar.

The squeeze collar 300 has a lower portion 310 having a number of inwardly extending securing members or lower detents 320. The squeeze collar 300 also has an upper portion 330 having inwardly extending securing members or upper detents 340. Preferably, lower detents 320 are formed adjacent to each other in series along the inner circumference of the lower portion 310 of the squeeze collar 300. Upper detents 340 are preferably diametrically opposed along the inner surface of the upper portion 330 of the squeeze collar 300. Upper detents 340 preferably have a chamfered or angled edge 345, which facilitates selective connection of the squeeze collar 300 with the inner bottle 200.

In the preferred embodiment, squeeze collar 300 has an inner diameter along its narrowest width including the inward extent of the lower and upper detents 320, 340 (based upon its unbiased oval shape) that is smaller than the outer diameter of first annular flange 135 of outer bottle 100 and second annular flange 235 of inner bottle 200. When the squeeze collar 300 is deformed by the user into a substantially circular shape, the inner diameter of the squeeze collar, including the inward extent of the lower and upper detents 320, 340, is larger than, or approximately equal to, the outer diameter of the first annular flange 135 of outer bottle 100 and the second annular flange 235 of inner bottle 200. This selective change in dimension allows the squeeze collar 300 to be selectively connected with the outer and inner bottles 100, 200 so that the outer and inner bottles can be easily assembled and removed from each other.

To facilitate the selective connection of the inner bottle 200 with the squeeze collar 300, the chamfered edge 345 of the upper detents 340 of the squeeze collar aligns with, and slides along, the chamfered lower edge 237 of the second annular flange 235. The directions of the chamfering or angles are opposite to each other to facilitate the upper detents 340 sliding past the second annular flange 235 and engaging therewith. The connection between the squeeze collar 300 and the outer bottle 100 is similarly provided for by the lower detents 320 being moved past the first annular flange 135 and engaging with the annular channel 140. The connection of the squeeze collar 300 and the outer bottle 100 requires less facilitation, and thus the edges are preferably not chamfered, since the squeeze collar does not need to be disengaged from the outer bottle in order for the inner bottle 200 to be removed from the outer bottle. Although, alternatively, these edges can also be chamfered.

When the squeeze collar 300 moves back into its unbiased position, the oval shape of the squeeze collar fittingly connects, engages or locks the outer and inner bottles 100, 200, as described above. The squeeze collar 300 preferably has grips or indicators 350 that facilitate deformation of the squeeze collar by providing a gripping surface, as well as indicating to the user the location on the collar that should be squeezed. Additionally, the squeeze collar 300 may have deformation areas that are more easily deformed or bent than the rest of the collar, such as, for example, areas of reduced wall thickness or areas made from a more flexible material than the rest of the collar. The indicators 350 can be disposed along the squeeze collar 300 so that the deformation occurs at these deformation areas.

Outer and inner bottles 100, 200 are further provided with anti-rotation structures to prevent the two bottles from rotating with respect to each other once they are engaged. In the preferred embodiment, the anti-rotation structures are inwardly extending first teeth 150 disposed on the inner surface of the first neck 130 of the outer bottle 100 and outwardly extending second teeth 250 disposed on the outer surface of the body 215 of the inner bottle 200, below the second annular flange 235.

The first and second teeth 150, 250 preferably have an undulating, wave-like shape that facilitates engagement and meshing of the teeth when the outer and inner bottles 100, 200 are engaged with each other, thereby preventing rotation of the inner and outer bottles with respect to each other. The large number of waves or teeth, as well as their curved, wave-like shape, facilitate the connection of the outer and inner bottles 100, 200, while requiring only a slight adjustment in orientation, at most, to mesh the first teeth 150 with the second teeth 250. While the preferred embodiment uses first and second meshing teeth 150, 250, the present invention contemplates other structures and methods of preventing rotation of the outer and inner bottles 100, 200 with respect to each other, such as, for example, corresponding detent members or a tight friction fit.

The preferred embodiment of bottle assembly 10 uses squeeze collar 300 to selectively connect, engage or lock the outer bottle 100 with the inner bottle 200. However, the present invention contemplates the use of alternative structures or methods of selectively engaging, connecting or locking the outer and inner bottles 100, 200, such as, for example, a rigid collar providing a snap-fit, a bayonet locking mechanism, corresponding threads, or a separate clamping or locking mechanism.

Additionally, the preferred embodiment uses squeeze collar 300 to lock and connect the inner bottle 200 in the outer bottle 200. The upper open end 105 of the outer bottle 100 and the upper open end 205 of the inner bottle 200 are sized and shaped so that the body 215 of the inner bottle fittingly engages in the body 115 of the outer body, while the squeeze collar 300 locks the inner and outer bottles in place. The present invention also contemplates other structures, shapes, sizes and methods of both fittingly engaging the inner bottle 200 in the outer bottle 100, as well as locking the bottles together, such as, for example, separating structures formed on the inner surface of the outer bottle to fittingly engage with the outer surface of the inner bottle or a separate locking mechanism that also fittingly engages, or assists in fittingly engaging, the inner bottle in the outer bottle.

In the preferred embodiment, outer bottle 100 is made from a rigid material. Inner bottle 200 is also preferably made from a rigid material. However, the present invention contemplates a bottle assembly 10 having other materials and combinations of materials with various properties, and which provides for selectively engaging the inner bottle 200 with the outer bottle 100 to form the insulated bottle assembly. Additionally, the outer and inner bottles 100, 200 are preferably transparent or semi-transparent to allow the contents and interior of the bottles to be seen during feeding and cleaning. Inner bottle 200 can be tinted with a different color than the color of outer bottle 100 to provide for contrast between the two bottles and to make the inner bottle and its contents more easily visible, e.g., a green inner bottle contrasting with a clear outer bottle.

The nipple ring 400 is mounted to the second neck 230 of the inner bottle 200, and preferably is threadingly engaged therewith. The nipple 500, which will be discussed later in greater detail, preferably includes an annular mounting flange 585. In the preferred embodiment, the flange 585 of the nipple 500 substantially seals against the rim 245 of the inner bottle 200 when the nipple ring 400 is screwed onto the inner bottle.

A protective hood 600 can be removably connected to the nipple ring 400 to keep the nipple 500 sanitary and to catch any leakage of fluid through the nipple. Hood 600 has retaining members 625. Retaining members 625 are projections or detents that extend inwardly from the inner surface of the hood 600 and provide for engagement between the hood and an annular channel 450 formed along the upper, outer circumference of the nipple ring 400. Preferably, pairs of retaining members 625 are diametrically opposed along the inner surface of hood 600 to provide for a balanced engagement of the hood with the nipple ring 400. Alternatively, other retaining structures or methods could also be used, such as, for example, a friction fit or threading engagement.

Figure 8:
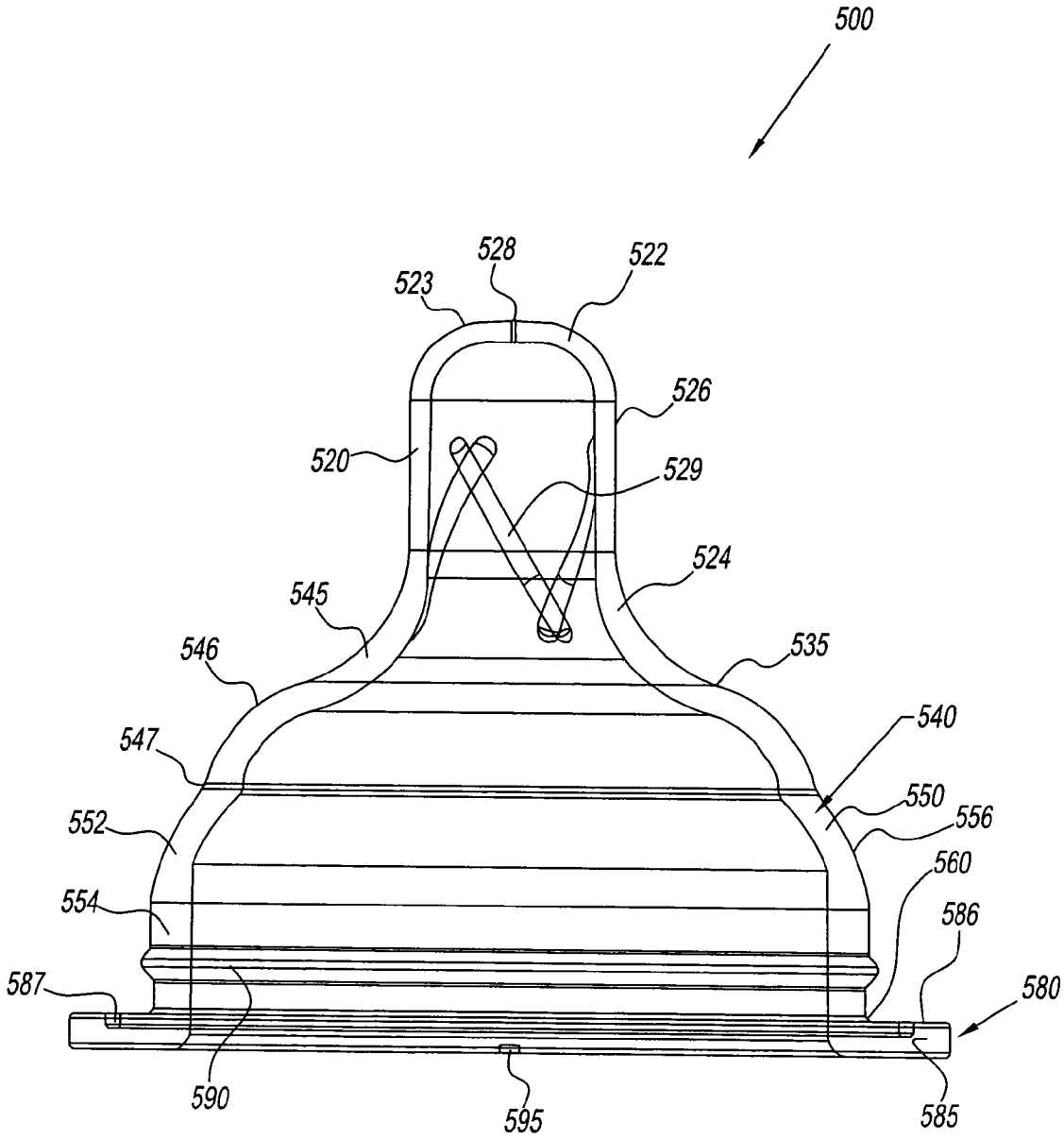
FIG. 8 is a cross-sectional view of the nipple of FIG. 2.

Referring to FIG. 8, nipple 500 has a stem 520 and a base 540 connected to the stem. Nipple 500 preferably also has a securing structure 580. Stem 520 has a first or distal end 522, a second or proximal end 524, and an outer surface 526. Base 540 has an areola region 545 with an outer surface 546 and a bulbous region 550 with an outer surface 556.

Stem 520 is substantially cylindrical in shape and is inwardly tapered from second end 524 toward first end 522. Preferably, stem 520 is smoothly, inwardly tapered in the vicinity of second end 524. However, alternative tapering of stem 520 can also be used including tapering over the entire length of the stem. First end 522 has an outwardly curved apex surface 523. Second end 524 of stem 520 preferably has an inwardly concave or dish-like, circular shape and more preferably a smooth shape.

The tapered shape of stem 520 towards first end 522 helps promote proper "latch-on" by the baby. During breast-feeding, the baby latches on to the areola of a woman's breast. Conventional nipples often promote latching on to the stem by having an indent located along the stem or being of a uniform cylindrical shape. This improper latching on promotes "nipple confusion", i.e., a baby forgets how to properly latch-on to a mother's breast. Tapered stem 520 promotes latching on to areola region 545. The tapered shape of stem 520 causes the baby to slide past the stem and onto areola region 545.

The present invention preferably further provides an elongated stem 520. Stem 520 is elongated to simulate the extension of the stem or teat of a woman's breast during breast-feeding, which has a shorter length when not breast-feeding.

First end 522 of stem 520 has at least one hole 528 disposed therethrough. Preferably, hole 528 is located at or about the center point of apex surface 523 at first end 522. The inner surface of stem 520 has a plurality of ribs 529 disposed thereon. Preferably there are at least three ribs 529. More preferably, ribs 529 are disposed at an angle with respect to the longitudinal axis of the stem 520. Ribs 529 provide strength to the stem 520 and also prevent complete collapse of the stem due to their inwardly extending shape.

Figure 9:
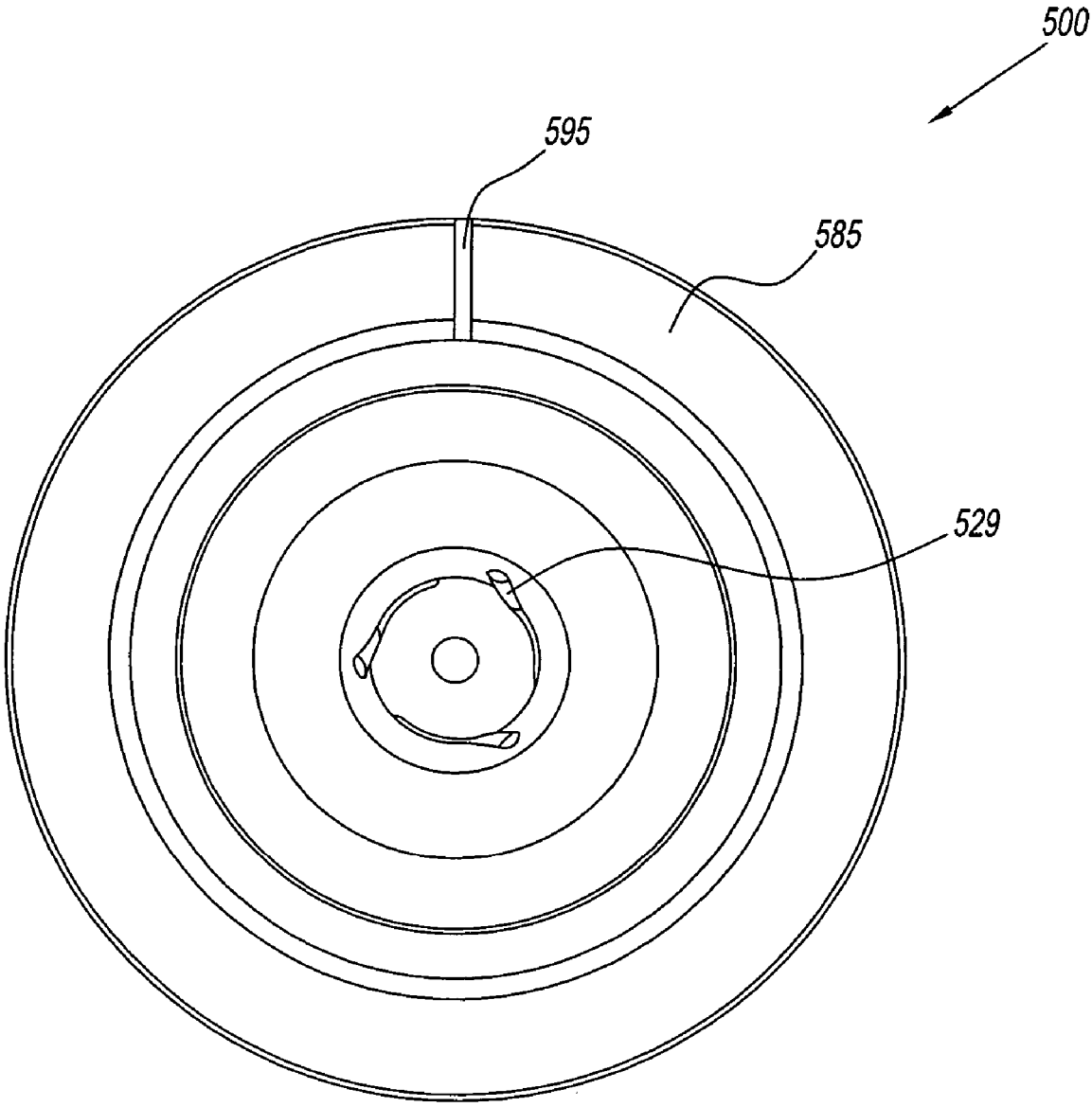
FIG. 9 is a bottom view of the nipple of FIG. 8.

Referring to FIGS. 8 and 9, second end 524 of stem 520 is secured to, and surrounded by, areola region 545 of base 540 along stem edge 535. Preferably, stem edge 535 is circular. Second end 524 is preferably integrally formed with areola region 545 along stem edge 535. Areola region 545 is designed to simulate the areola of a woman's breast. Areola region 545 preferably has an outwardly curved, convex or raised shape providing a raised appearance and feel. This raised appearance and feel allows a baby to latch on to areola region 545 just as a baby would latch on to the areola of a woman's breast during breast-feeding.

The preferred embodiment provides for different textures, surface geometries, and feels for different surfaces of nipple 500. The terms texture, surface geometry and feel include the shape of the surface when viewed parallel to the surface. The terms texture, surface geometry and feel also include different materials, or variations to the properties of a material, to provide a different feel for the baby, such as, for example, hard and soft materials or different coefficients of frictions between the materials.

Outer surface 546 of areola region 545 has a different texture, surface geometry or feel, on at least a portion thereof, as compared to at least a portion of outer surface 526 of stem 520 and at least a portion of outer surface 556 of bulbous region 550. Preferably, all of outer surface 546 has a different texture, surface geometry or feel than all of outer surface 526 and all of outer surface 556. By providing outer surface 546 with a different texture, surface geometry or feel as compared to outer surface 526 and outer surface 556, the baby receives a signal for latching on and also receives a grip for latching on. The signal is preferably provided by the appealing tactile feel of the outer surface 546, as compared to the rest of the nipple 500. Preferably, outer surface 526 and outer surface 556 have a smooth texture, surface geometry or feel, while outer surface 546 of areola region 545 has a rough texture, surface geometry or feel. By providing outer surface 526 of stem 520 with a smooth texture, as well as tapering the stem, the baby will more easily slide down the stem and onto areola region 545 for proper latch on. More preferably, the rough texture of the outer surface 546 is continuously formed along the surface rather than being discrete bumps.

Outer surface 546 can have alternative textures or surface geometries including dimples, ribs or other non-smooth textures. While the present invention preferably has areola region 45 with an outwardly curved, convex or raised shape providing a raised appearance and feel, the present invention also contemplates other shapes and/or textures for areola region, such as, for example, concave or recessed, which facilitate an infant in latching on to the areola region. Also, areola region 545 with outer surface 546 can be a different material than stem 520 with outer surface 526 and bulbous region 550 with outer surface 556, such as, for example, the stem and bulbous region can be silicone and the areola region can be a plastic, such as, for example, a thermoplastic elastomer (TPE).

Additionally, outer surface 546 can be a different material than the rest of nipple 500, such as, for example, molding nipple 500, including outer surfaces 526 and 556, with silicone or another material that is different from TPE, and over-molding TPE on outer surface 546. Outer surface 546 can have alternative textures or surface geometries including coarse, cross-hatched, egg-shelled, tactile, structured, such as dimples or ribs, or other non-smooth textures.

Preferably, the texture, surface geometry or feel of outer surface 546 and the texture, surface geometry or feel of outer surfaces 526 and 556, are obtained during the molding process. The desired texture is added to those portions of the cavity and core corresponding to outer surface 546 and outer surfaces 526 and 556. Alternatively, the texture, surface geometry or feel of outer surface 546 can be obtained by a secondary process after nipple 500 is molded. In this embodiment, the rough texture of outer surface 546 can be obtained by texturing that portion of the cavity and core corresponding to outer surface 546 by electrical discharge machining, chemical etching, or any other known machining or texturing method. The portion of the cavity and core corresponding to outer surface 526 of stem 520 and outer surface 556 of bulbous region 550 can be polished to a smooth or fine finish to provide for a smooth texture, surface geometry or feel of outer surfaces 526 and 556.

Areola region 545 is connected to, and surrounded by, bulbous region 550 along areola edge 547. Preferably, areola edge 547 is circular. Areola region 545 is preferably integrally molded or formed with bulbous region 550 along areola edge 547.

Bulbous region 550 is designed to simulate the region of a woman's breast that surrounds the areola region. Bulbous region 550 preferably has an outwardly curved or convex shape. In the preferred embodiment, the surface area of bulbous region 550 is greater than the surface area of areola region 545. Areola region 545 is preferably substantially concentrically aligned with bulbous region 550 in a top view. Also, stem 520 is preferably substantially concentrically aligned with both areola region 545 and bulbous region 550, in a top view. As shown in the plan cross-sectional view of FIG. 8, second or proximal end 524 of stem 520 has opposing sides with inwardly concave shapes, when viewed in a front view. Areola region 545 and second end 524 of stem 520 are connected along an inwardly smooth concave surface.

Bulbous region 550 has an upper portion 552 and a lower portion 554. Upper portion 552 extends curvingly downward from areola edge 547 to form an outwardly convex or raised shape. Lower portion 554 extends substantially vertically downward from upper portion 552. By providing outer surface 556 of bulbous region 550 with a smooth surface, as well as upper portion 552 of the bulbous region with an outwardly convex shape, the baby will more easily slide back onto areola region 545 for proper latch-on.

Bulbous region 550 is connected to, and surrounded by, securing structure 580 along bulbous edge 560. Bulbous edge 560 is preferably circular. Bulbous region 550 is preferably integrally formed with securing structure 580 along bulbous edge 560.

Securing structure 580 has flange 585 with an upper surface 586. Flange 585 extends outwardly from bulbous edge 560 and is preferably circular in shape. More preferably, flange 585 is perpendicular to outer surface 556 of lower portion 554. Preferably, flange 585 is integrally formed with and surrounds bulbous edge 560. Flange 585 allows a nipple ring or other securing device to substantially sealingly engage nipple 500 to inner bottle 200 through a downward compression force upon upper surface 586 of the flange against rim or leading edge 245 of the inner bottle.

Flange 585 preferably has a securing channel 587 formed in upper surface 586. Securing channel 587 is an annular channel or groove on upper surface 586 of flange 585. Securing channel 587 can be used for locking and sealing flange 585 to nipple ring 400.

Lower portion 554 of bulbous region 550 has a locking ring 590. Locking ring 590 is an annular ring extending outwardly from lower portion 554. Preferably, locking ring 590 is integrally formed or molded with lower portion 554. Locking ring 590 is preferably parallel to flange 585 so that the distance between the locking ring and the flange is the same along the entire circumference of lower portion 554. In this embodiment, locking ring 590 is triangular in shape but alternative shapes can be used, such as, for example, a semi-circular ring. Locking ring 590 provides an engagement structure or locking structure between nipple 500 and the nipple ring 400 so that the nipple and nipple ring can remain assembled while removed from the baby bottle.

Nipple 500 preferably has a vent 595. Preferably vent 595 is a channel or groove formed along the lower surface of flange 585. Vent 595 provides communication between the inner volume of inner bottle 200 and the atmosphere. While the present invention provides a groove or channel for vent 595 that vents the inner bottle between the lower surface of nipple flange 585 and the inner bottle rim 245, alternative structures, methods, and positionings can be used to vent the bottle assembly 10.

Nipple 500 is preferably made of a flexible, resilient material. More preferably, nipple 500 is made from silicone, latex, or other rubber materials. This material provides flexibility to nipple 500 that further simulates the function of a woman's breast during breast-feeding.

During breast-feeding, a baby latches on to the areola region of a woman's breast. The present invention provides areola region 545 on nipple 500 for a baby to latch on to during bottle feeding. Areola region 545 is a raised or outwardly convex surface that facilitates latch on by the baby and promotes a more secure engagement for the baby, which reduces air leakage into nipple 500 or liquid leakage from the nipple.

Figure 10:
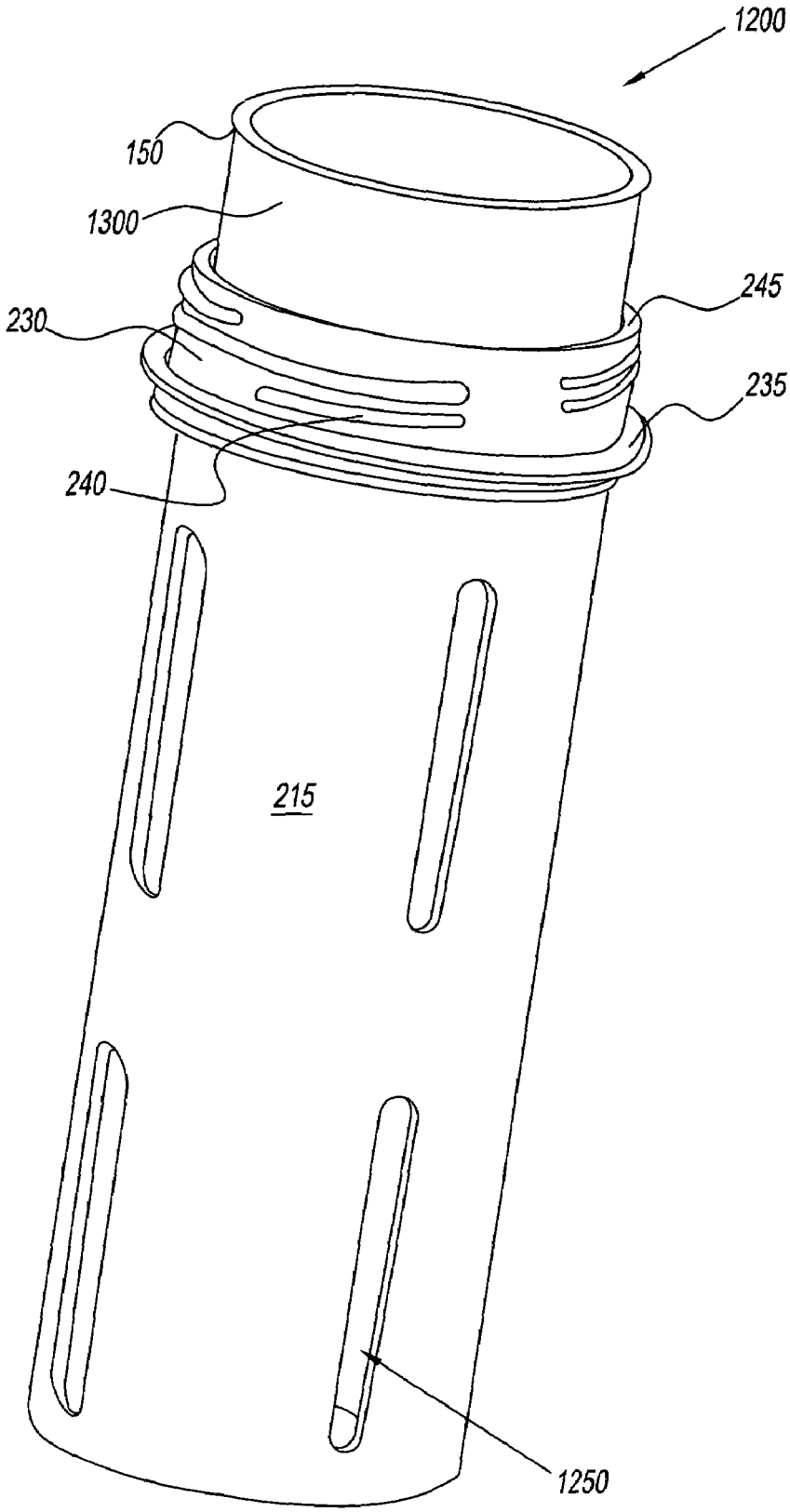
FIG. 10 is a perspective view of an alternative embodiment of the inner bottle for the bottle assembly of FIG. 1 with a flexible liner.

Referring to FIG. 10, an alternative embodiment of an inner bottle that is usable with the bottle assembly 10 is shown and generally represented by reference numeral 1200. Inner bottle 1200 has many of the same features of inner bottle 200 of the preferred embodiment of FIGS. 1 through 9, including body 215, second neck 230, second annular flange 235 and threads 240. However, inner bottle 1200 is usable with a disposable or flexible liner 1300. Flexible liner 1300 has an outer diameter that is smaller than the inner diameter of body 215 so that the liner can be disposed in the inner bottle 1200. Flexible liner 1300 has a flange 1350 that extends outwardly from a top of the liner and can be seated upon the rim 245 of the inner bottle 200. Body 215 of inner bottle 1200 has a number of slots 1250 formed therein. Slots 1250 facilitate the liner 1300 collapsing during feeding.

Figure 11:
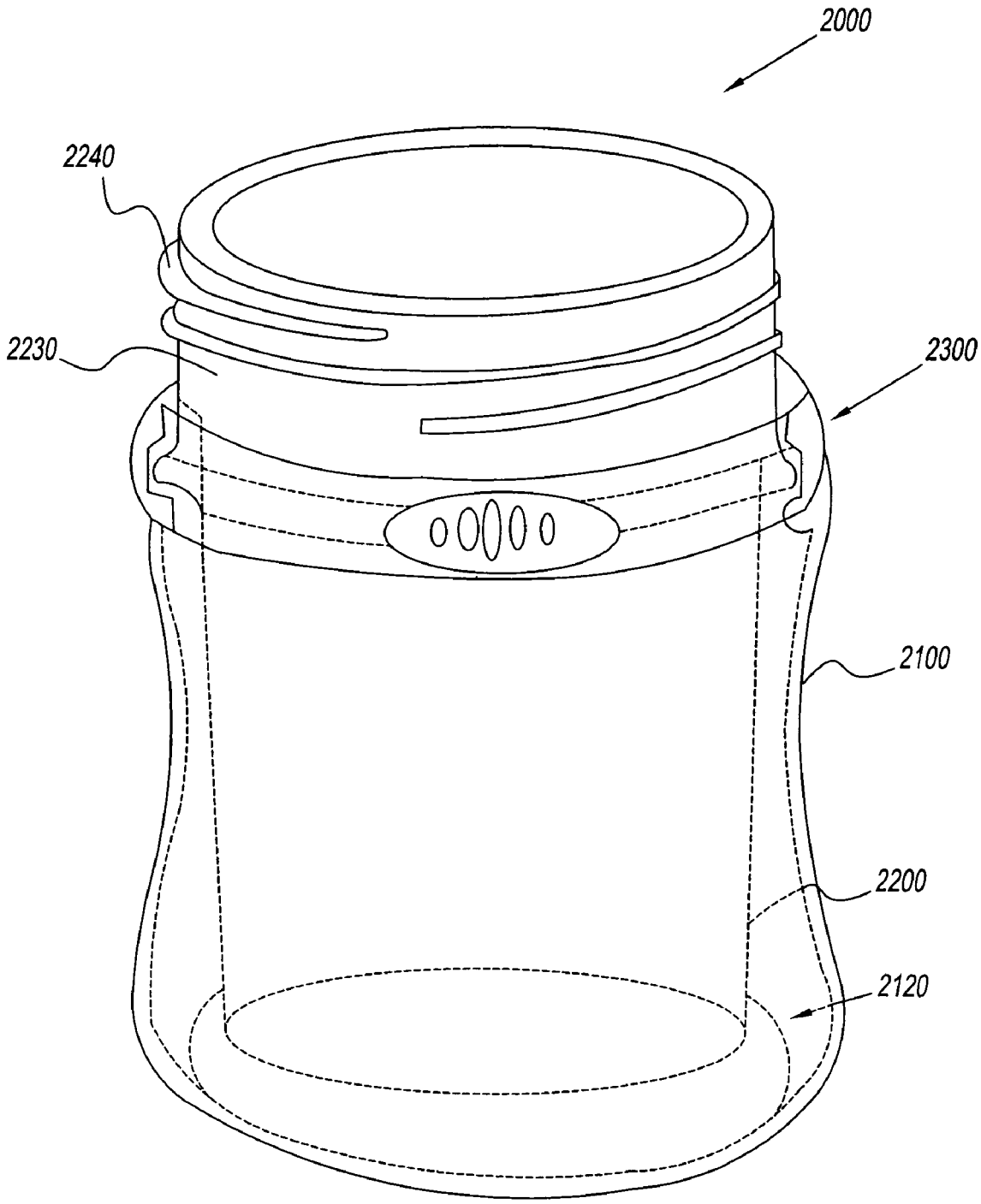
FIG. 11 is a perspective view of an alternative embodiment of the bottle assembly of the present invention with the inner bottle shown in phantom.

Referring to FIG. 11, an alternative embodiment of the bottle assembly is shown and generally represented by reference numeral 2000. Bottle assembly 2000 has many features that are similar to the bottle assembly 10 of the preferred embodiment of FIGS. 1 through 9, including outer bottle 2100, inner bottle 2200, and squeeze collar 2300. Bottle Assembly 2000 is adapted for use with a valved or spill-proof lid (not shown) that removably connects to threads 2240 disposed on neck 2230 of inner bottle 2200. Additionally, inner bottle 2200 can be used alone as a spill-proof cup or connected with outer bottle 2100 to form the separation or thermally insulated volume 2120.

The preferred embodiment uses various engagement or connection structures to selectively connect the various components of bottle assembly 10 to each other, such as, for example, squeeze collar 300 and threaded nipple ring 500. However, the present invention contemplates the use of other securing methods and structures for assembly of the various components of bottle assembly 10 to provide for an insulated bottle with removable bottle bodies 115, 215.

Bottle assembly 10 facilitates manufacture of the insulated bottle since the components do not need to be permanently secured through welding and the like. Bottle assembly 10 also facilitates cleaning since all of the components can be disassembled and there is no condensation that forms between the outer and inner bottles 100, 200, since they are separable. Additionally, the removability feature of inner bottle 200 from outer bottle 100 provides additional safety when feeding a heated drink because the inner bottle can be felt for heat rather than the outer surface of the bottle assembly 10, which is insulated from the inner bottle. The inner bottle 200 can be heated or cooled directly rather than through the insulation layer, e.g., air, which improves the efficiency of the heating or cooling of the contents of the inner bottle. Inner bottle 200 can also be stored alone or used to feed the child directly, where the thermal insulative property is not desired.

The preferred embodiment describes the features of bottle assembly 10 with respect to a baby bottle and includes components for feeding of a baby, such as the feeding apparatus of nipple 500. However, the present invention contemplates the use of one or more of the features described herein, individually and in combination with each other, for alternative uses, such as, for example, children's spill-proof cups, sport cups, or food/liquid storage. Various components of these alternative uses can be interchanged with components of the bottle assembly 10, such as, for example, using the removable outer and inner bottles 100, 200 with a spill-proof valve and spout or a sealing cap for food/liquid storage.

The present invention having been thus described with particular reference to the preferred forms thereof, it will be obvious that various changes and modifications may be made therein without departing from the spirit and scope of the present invention as defined in the appended claims.

What is claimed is:

1. An insulated bottle comprising:

an outer body;

an inner body having an inner volume for storage therein and being selectively connectable with said outer body; and a flexible member selectively connecting said outer body with said inner body, said flexible member being at least substantially disposed outside of said outer body, wherein said flexible member is deformed from a first shape into a second shape to provide for connection of said outer body with said inner body, wherein said inner body is at least substantially disposed in said outer body when connected thereto, and wherein said inner and outer bodies when connected form a gap therebetween, wherein either or both of said outer body and said inner body have anti-rotation structures that prevent said outer and inner bodies from rotating with respect to each other when connected, and wherein said anti-rotation structures are a first detent structure formed on an outer surface of said inner body and a second detent structure formed on an inner surface of said outer body, and wherein said first and second detent structures are engageable, wherein said flexible member has an oval shape.

2. The bottle of claim 1, wherein said first detent structure is a first set of teeth and said second detent structure is a second set of teeth, and wherein said first and second set of teeth mesh.

3. The bottle of claim 2, wherein said first set of teeth extend continuously along an outer circumference of said inner body and said second set of teeth extend continuously along an inner circumference of said outer body.

4. The bottle of claim 1, wherein said outer body has a first open end, a first closed end, and a middle or upper-middle portion, said middle or upper-middle portion having a smaller diameter than diameters of said first open and closed ends.

5. An insulated bottle comprising:

an outer body;

an inner body having an inner volume for storage therein and being selectively connectable with said outer body; and a flexible member selectively connecting said outer body with said inner body, wherein said inner body is at least substantially disposed in said outer body when connected thereto, and wherein said inner and outer bodies when connected form an insulating gap therebetween, wherein said flexible member has an oval shape, and wherein said flexible member is a ring having an inner surface with first and second securing members, wherein said first securing member connects said flexible member to said outer body, and wherein said second securing member connects said flexible member to said inner body.

6. The bottle of claim 5, wherein said outer body has a first flange extending outwardly therefrom, said inner body has a second flange extending outwardly therefrom, said first securing member removably connects to said first flange, and said second securing member removably connects to said second flange.

7. The bottle of claim 6, wherein said second securing member is a pair of securing members diametrically opposed along said inner surface of said flexible member.

8. The bottle of claim 7, wherein said pair of securing members each have a distal edge that is chamfered, and wherein said second flange has a lower edge that is chamfered.

9. The bottle of claim 7, wherein said flexible member has an outer surface opposite said inner surface, and wherein said outer surface has a pair of indicators disposed thereon, said indicators representing a portion of said flexible member that is to be squeezed thereby disconnecting said inner body from said flexible member.

10. An insulated bottle comprising:

an outer body having a first open end, a first closed end, a first annular flange at said first open end, said first annular flange defining a first annular channel between said first annular flange and said first closed end; and an inner body having a second closed end and a neck defining a second open end, said neck including a second annular flange formed along an outer circumference of said neck and a threaded portion at said second open end, said second annular flange defining a second annular channel in said neck between said threaded portion and said second closed end, said inner body being removably positioned in said outer body so that said second annular flange is on said first annular flange and so that said inner and outer bodies define a closed insulating air gap therebetween; and a flexible collar moveable between a first position having first securing members in said first annular channel and second securing members in said second annular channel to lock said first and second flanges to one another and a second position having first and second securing members released from said first and second annular channels, respectively, to release said first and second flanges from one another, said threaded portion extending above said collar in said first position.

11. The insulated bottle of claim 10, further comprising:

a feed apparatus having an annular mounting flange, said annular mounting flange being positioned on a rim of said inner body at said second open end; and a nipple ring threadably secured to said threaded portion to seal said annular mounting flange to said rim.

12. The insulated bottle of claim 11, wherein said feed apparatus comprises a nipple.

13. The insulated bottle of claim 10, further comprising:

first anti-rotation structures on said outer body; and second anti-rotation structures on said inner body, said first and second anti-rotation structures for preventing rotation of said inner and outer bodies with respect to one another when said collar is in said first position.

14. The insulated bottle of claim 10, wherein said outer body has a middle or upper-middle portion, said middle or upper-middle portion having a smaller diameter than diameters of said first open and closed ends.

15. An insulated bottle comprising:

an outer body having a first open end, a first closed end, a first annular flange at said first open end; and an inner body having a second closed end and a neck defining a second open end, said neck including a second annular flange formed along an outer circumference of said neck and a threaded portion at said second open end, said second annular flange being between said threaded portion and said closed end, said inner body being removably positioned in said outer body so that said second annular flange is on said first annular flange and so that said inner and outer bodies define a closed insulating air gap therebetween; and a collar moveable between a first position locking said first and second flanges to one another and a second position releasing said first and second flanges from one another, said threaded portion extending above said collar in said first position, wherein said collar has an oval shape.

16. A method of thermally insulating contents of a bottle assembly comprising:

placing a first bottle in a second bottle;

deforming a flexible member from a first shape to a second shape;

placing said flexible member over a first outside portion of said first bottle and a second outside portion of said second bottle;

capturing air between said first and second bottles to form an insulation layer for the contents of said second bottle; and allowing said flexible member to return to said first shape so that said flexible member secures said first and second outside portions to one another.

17. The method of claim 16, further comprising preventing rotation of said first and second bottles with respect to each other after being connected.

* * * * *